US007445036B2

(12) United States Patent
Kolbeck et al.

(10) Patent No.: US 7,445,036 B2
(45) Date of Patent: Nov. 4, 2008

(54) LIQUID-COOLED PERMANENT MOLD

(75) Inventors: Dietmar Kolbeck, Steinfeld (DE); Hans-Günter Wobker, Bramsche (DE); Gerhard Hugenschütt, Belm (DE)

(73) Assignee: KM Europa Metal AG, Osnabruck (DE)

( * ) Notice: Subject to any disclaimer, the term of this patent is extended or adjusted under 35 U.S.C. 154(b) by 587 days.

(21) Appl. No.: 10/917,896

(22) Filed: Aug. 13, 2004

(65) Prior Publication Data

US 2005/0034838 A1 Feb. 17, 2005

(30) Foreign Application Priority Data

Aug. 13, 2003 (DE) ..... 103 37 205

(51) Int. Cl.
*B22D 11/124* (2006.01)

(52) U.S. Cl. ..... 164/443; 164/418

(58) Field of Classification Search ..... 164/485, 164/444, 418, 443

See application file for complete search history.

(56) References Cited

U.S. PATENT DOCUMENTS 4,150,714 A * 4/1979 Atkins et al. ..... 164/440
5,119,883 A * 6/1992 Wagstaff et al. ..... 164/487
6,736,202 B2 * 5/2004 Hauri et al. ..... 165/168
6,827,127 B2 * 12/2004 Hauri ..... 164/459
6,926,067 B1 8/2005 Horneschemeyer et al.
2003/0106681 A1 6/2003 Hauri et al.

FOREIGN PATENT DOCUMENTS

JP 59-133940 * 8/1984
JP 61-195746 * 8/1986
JP 2-11249 * 1/1990
JP 11-207442 * 11/1999

* cited by examiner

*Primary Examiner*—Kuang Lin
(74) *Attorney, Agent, or Firm*—Kenyon & Kenyon LLP

(57) ABSTRACT

A liquid-cooled permanent mold for a continuous casting installation having a shaping permanent mold body, for example, made of copper or copper alloy. Cooling channels are provided in permanent mold body that extend from its upper side to its lower side. The cooling channels each have two longitudinal sections and the cooling sections have an alignment of their longitudinal axes that differ from one another. In this way, the horizontal distance of the cooling channels from the casting surface is varied and a cooling performance is achieved that is adjusted to the weighting profile of the permanent mold.

15 Claims, 3 Drawing Sheets

LIQUID-COOLED PERMANENT MOLD

RELATED APPLICATIONS

The present application claims priority to German Patent Application Serial No. 103 37 205.9, filed Aug. 12, 2003, the entire disclosure of which is incorporated herein by reference.

FIELD OF THE INVENTION

The present invention relates to a liquid-cooled permanent mold for a continuous casting installation.

BACKGROUND INFORMATION

Permanent molds are used for producing solid shapes in a continuous casting process. The permanent mold is one of the most important components in a continuous casting installation. Solidification of the melt begins in the permanent mold. In principle, the structure is made up of an outer steel construction and the actual forming part of the mold, the mold body. The mold body is generally made almost exclusive of copper or a copper alloy. For applications in which high or the highest thermal stresses appear, CuAg substances or CuCrZr substances are used.

Permanent molds are supposed to withdraw heat from the molten metal, and make possible a solidification all the way through the strand by way of the strand shell that forms at the beginning. In the casting process, especially in the area of the casting level of the permanent mold body, large quantities of heat have to be removed from the melt. The permanent mold body is cooled because, above all, at high casting speeds, there is a danger that, in this context, on a local basis, the permissible thermal load of the permanent mold material is exceeded. In this connection, an effort is made to cool the casting side of the permanent mold body to the largest extent and as homogeneously as possible.

Consistent with the disclosure of German Patent No. 41 27 333 C2, a continuous casting permanent mold is a part of the related art whose form wall is furnished with continuous cylindrical cooling water lines connected to a cooling water circulation.

In the range of the highest temperature weighting, the cross sectional areas of the cooling water lines are reduced by displacement rods in order to increase the flow speed of the cooling water. It is intended to thereby improve the dissipation of heat in the area of the highest temperature weighting and to reduce the wall temperature.

In order to counter the higher heat input, appearing at the broad face walls of the permanent mold body, with an even higher cooling effect, it is proposed in EP 0 931 609 A1 to position more closely the cooling lines, from place to place. The result is that an increased cooling effect is created over the entire height of the permanent mold.

However, the requirement of setting a cooling effect adjusted to certain zones of the permanent mold, such as the casting level, can only be achieved in a limited way.

Therefore, starting from the related art, an object of an exemplary embodiment of the present invention is to provide a liquid-cooled permanent mold in which a horizontally and vertically adjusted cooling effect is possible.

SUMMARY OF THE INVENTION

An exemplary embodiment of a liquid-cooled permanent mold for a continuous casting installation of the present invention includes a shaping permanent mold body (1, 18) made of a substance of high heat conductivity, such as copper or a copper alloy. Cooling channels (5, 19, 20) are provided in the permanent mold body (1, 18) that extend from its upper side (6, 25) to its lower side (7, 26) and at least one cooling channel (5, 19, 20) has two longitudinal sections (10, 11; 21, 22; 23, 24). The longitudinal sections (10, 11; 21, 22; 23, 24) have alignments of their longitudinal axes (L1, L2) that are different from one another and the distance of the cooling channel (5, 19, 20) from the casting surface (F) in the permanent mold body (1, 18) varying.

The cooling channels are brought closer to the casting surface, specifically in the zones of greater thermal weighting. At least one cooling channel has two longitudinal sections, the longitudinal sections having a different alignment of their longitudinal axes from each other.

In this way, the horizontal distance of the cooling channel from the casting surface, that is, to the inner wall of the mold body, is varied, and a cooling performance is achieved that is adjusted to the weighting profile of the mold. Because of the corresponding setting of the angle of the longitudinal axes of the longitudinal sections or the slope of the longitudinal sections, one may make a purposeful adjustment in the cooling effect to the corresponding zone.

The cooling medium is guided through the cooling channels and in the hot zones it approaches more closely to the casting surface. Above and below the hot zone, the distance of the cooling channels from the hot zone increases continuously. This not only considerably reduces the weighting in the hot high region of the casting level, but also makes uniform the heat weighting over the entire height of the mold.

In addition, it is ensured by the proposed adjusted zone cooling effect, according to an exemplary embodiment of the present invention, that in the highly weighted regions of the mold the recrystallization temperature of the copper is not reached on the hot side. Vaporization of the cooling medium at the cold side is also avoided.

All channels may be designed to have bent longitudinal axes. Of course, a combination of individual cooling channels or cooling channels combined in groups, having a straight and/or bent course is also possible.

Depending on the specific embodiment and the particular case of application of the mold, the longitudinal sections of a cooling channel may be equally long or have different lengths.

In an exemplary embodiment of the present invention, at least one cooling channel, expediently all cooling channels run in a permanent mold wall inclined or at an angle to the adjacent inner surface of the permanent mold body. Consequently, the cooling channel or cooling channels are made of a straight-line longitudinal section, which, however, is tilted with respect to the longitudinal axis (casting direction) of the permanent mold.

An adjusted horizontal and vertical cooling effect may also be achieved in the permanent mold body in this way.

The technological connection of the above exemplary embodiments of the present invention may be seen in that a horizontally and vertically adjusted cooling effect in the permanent mold body is possible. Basically, the cooling channels may be cooling slots. Preferably, however, the cooling channels are designed to be bores.

Since, in the case of plate molds, in particular the broad face walls of the mold body are highly weighted locally, the cooling channels are preferably provided in the broad face walls.

In an exemplary embodiment of a permanent mold according to the present invention, not only the longitudinal course of the cooling channels varies, but, in addition, also their distance from one another. Thereby, a three-dimensional variation in the cooling performance of the permanent mold is possible. Accordingly, the cooling intensity may be increased and made uniform in the thermally highly weighted zones.

It should be understood that the design, according to the present invention, of the cooling channels is suitable for different types of permanent mold, for example, for plate molds, tube molds or beam blanks, etc.

The present invention is described in detail below, using an exemplary embodiments represented in the drawings.

DETAILED DESCRIPTION

Figure 1:
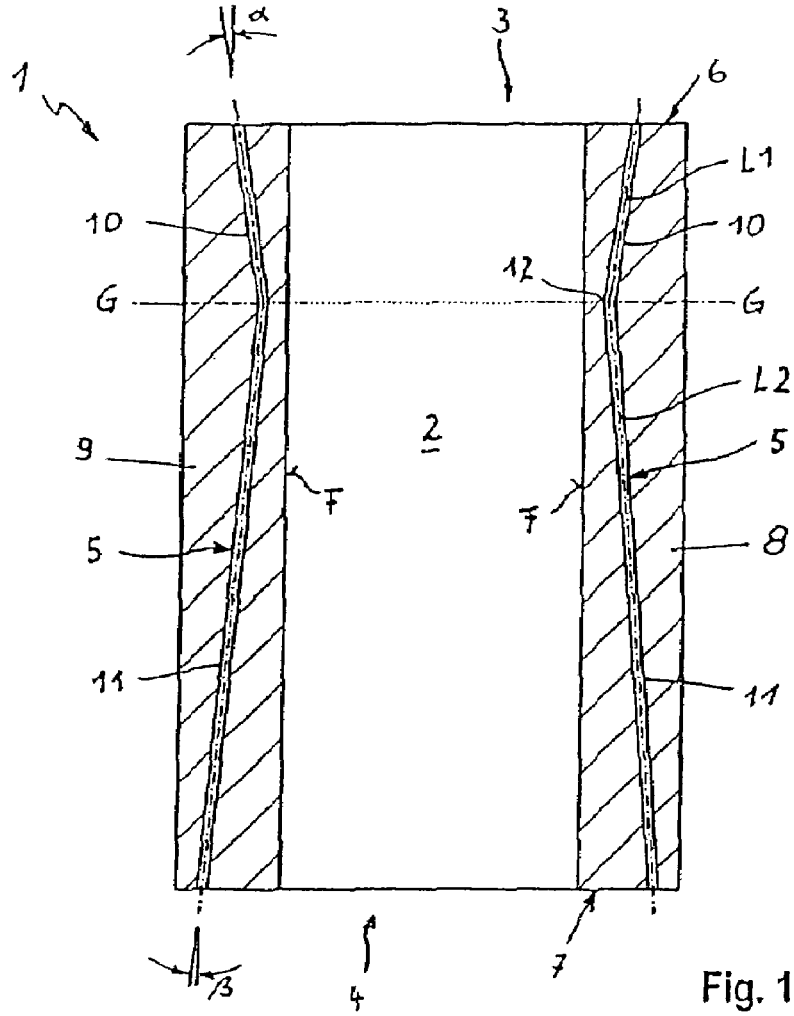
FIG. 1 is a vertical section of a technically simplified representation of an exemplary embodiment of a permanent mold body of the present invention.

FIG. 1 shows, simplified, a permanent mold body 1 for the continuous casting of steel. The representation is not to scale.

Permanent mold body 1 is made, for example, of a copper alloy, and has an inner forming cavity 2, whose cross section may be dimensioned greater at input casting end face 3 than at strand output bottom end 4.

Cooling channels 5 are provided, for cooling permanent mold body 1, which run from its upper side 6 to lower side 7 in sidewalls 8, 9.

Cooling channels 5 are formed by bores, and have in each case two longitudinal sections 10, 11, that have longitudinal axes L1, L2 that are aligned differently from each other. Longitudinal section 10 is directed, starting from upper side 6, at an angle with respect to the vertical, towards form cavity 2, and in the area of casting level, labeled G, it reaches its closest position to form cavity 2. Longitudinal section 11 extends as a bore, starting from underside 7, set at an angle beta, towards form cavity 2, and meets longitudinal section 10 in the area of casting level G. Consequently, cooling channel 5 has an inflection point in the area of casting level G, having a kink 12.

Because of the slanting course of longitudinal sections 10, 11, the horizontal distance of cooling channel 5 from casting surface, labeled F, in form cavity 2 changes over the height of permanent mold body 1. In this manner, the cooling effect in permanent mold body 1 is appropriately adjusted to the imposed thermal weighting.

Figure 2:
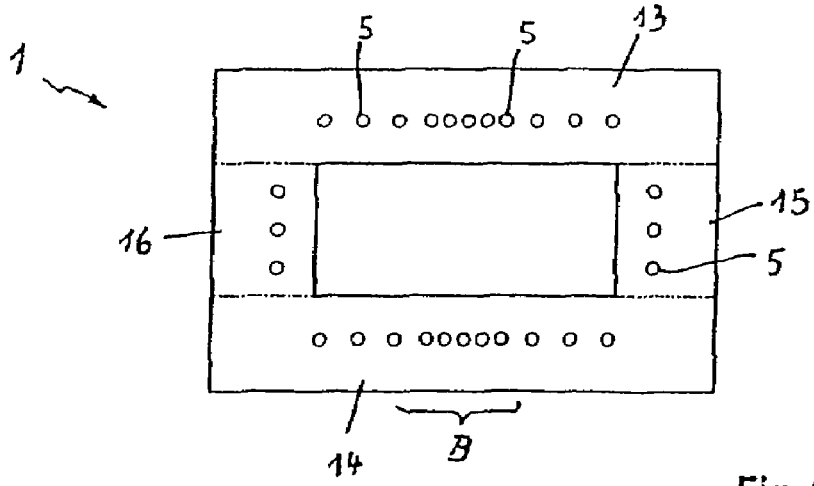
FIG. 2 is a top view on to a permanent mold body of FIG. 1.

With respect to permanent mold body 1, a plate mold body may be involved or a tube mold body. In FIG. 2 this is intimated by the use of differently bold lines. A plate mold body has two broad face walls 13, 14 lying opposite each other, and two narrow face walls 15, 16, which limit the width of the strand. A tube mold body is made from a block. The division intimated in FIG. 2 by broken lines between broad face walls 13, 14 and narrow face walls 15, 16 is not present in a tube mold body.

As FIG. 2 shows, cooling channels 5 are situated in broad face walls 13, 14. These are designed to have a bent shape, as described before. In addition, cooling channels 5 are provided also in narrow face walls 15, 16. Besides the bent cooling channels 5, cooling channels formed in a straight line may also be provided.

It may further be seen in FIG. 2 that the distance between adjacent cooling channels 5 in broad face walls 13, 14 varies. In thermally and mechanically greater stressed regions B, cooling channels 5 may be arranged closer together.

Figure 3:
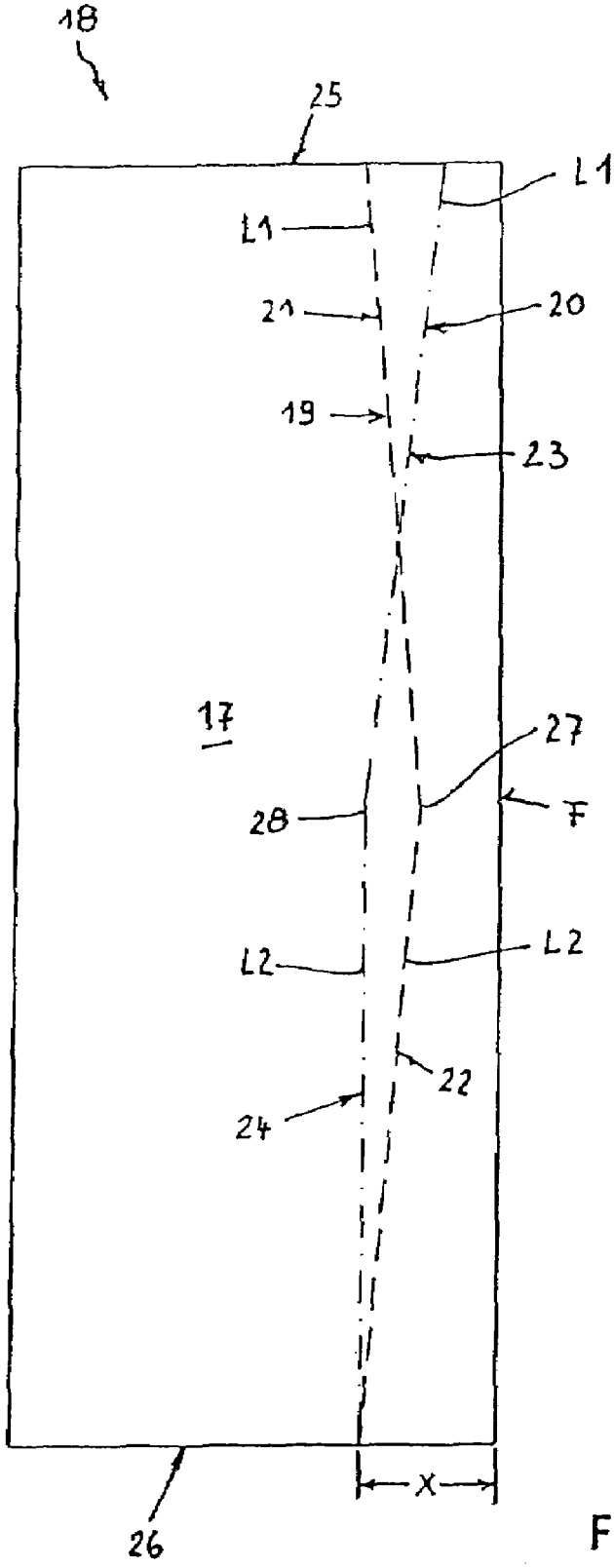
FIG. 3 is a side view onto a permanent mold wall of FIG. 1 together with a representation of two different cooling channels.

FIG. 3 shows a view onto a permanent mold wall 17 of a permanent mold body 18, along with the representation of two different courses of cooling channels 19, 20. Cooling channel 19 is schematically intimated by a broken line and cooling channel 20 by a dot-dashed line.

Each cooling channel 19 and 20 has two longitudinal sections 21, 22 and 23, 24 having longitudinal axes L1 and L2 that are aligned differently to one another. Because of that, the distance, labeled x, of cooling channels 19, 20 from casting surface F varies over the vertical plot. Longitudinal section 21 of cooling channel 19 is directed towards casting surface F, starting from the upper end 25 of permanent mold wall 17. Longitudinal section 22 extends in the direction of casting surface F, starting from under side 26 of permanent mold 17. Longitudinal sections 21 and 22 meet at kink 27.

At cooling channel 20 longitudinal section 23, starting from upper end 25, runs in a downward direction away from casting surface F, until, about halfway up permanent mold wall 17, it meets longitudinal section 24 at kink 28. Longitudinal section 24, on its part, runs downwards, vertically aligned parallel to casting surface F.

Because of the variation in the longitudinal pattern of cooling channels 5 and 19, 20, respectively, as described above, a targeted adjustment with regard to weighting of the cooling effect on thermally and mechanically highly weighted zones may be set. In addition, the cooling intensity may be increased in the greatly weighted zones, by choosing the distances apart of cooling channels 5, 18, 19 relative to one another to be tighter.

All in all, a three-dimensional variation in cooling performance can be achieved in the case of the mold proposed according to the present invention.

Figure 4:
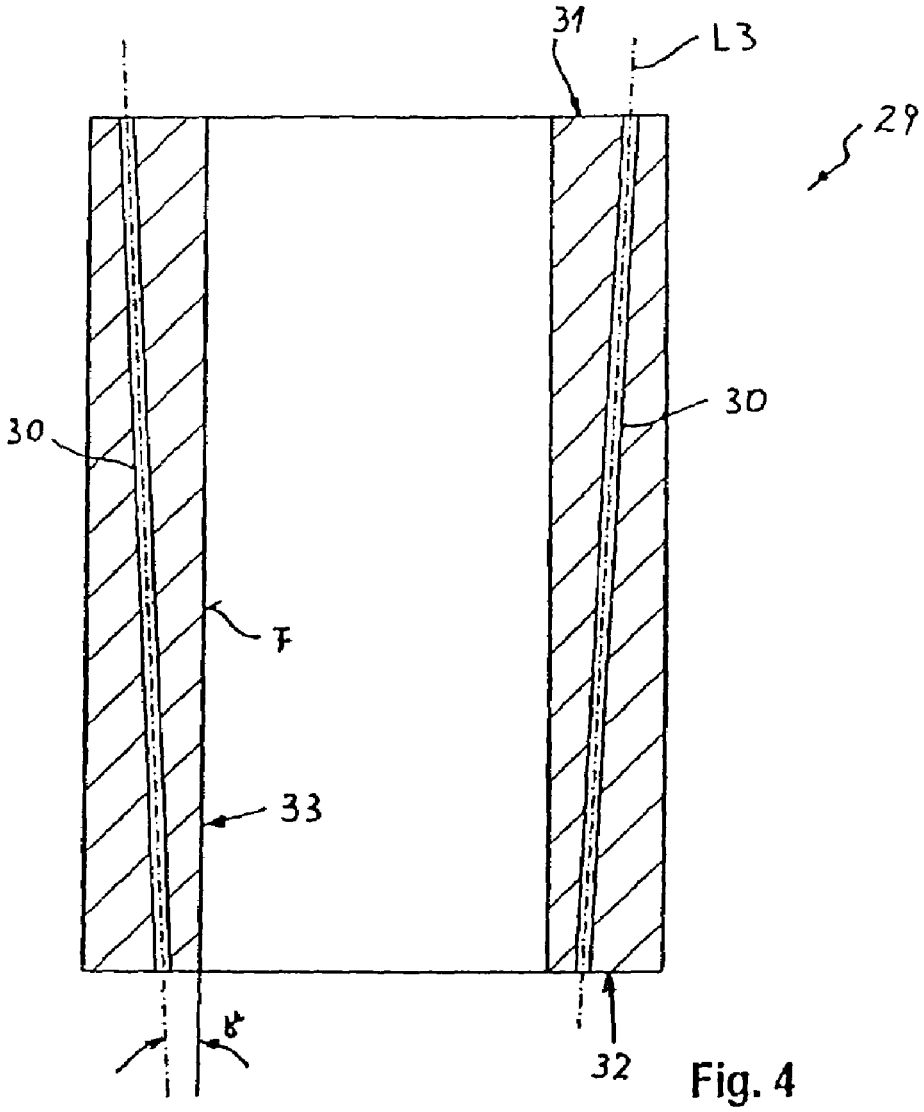
FIG. 4 is a vertical section of a technically simplified representation of another exemplary embodiment of a permanent mold body of the present invention.

An alternative exemplary embodiment of a permanent mold body 29 is shown in FIG. 4. Here too, a plate mold or a tube mold or a beam blank may be involved. Cooling channels 30 provided in permanent mold body 29 extend from upper side 31 to lower side 32. In this connection, cooling channels 30 run at an inclination with respect to neighboring inner surface 33, and thus, compared to casting surface F. The angle of inclination of longitudinal axis, labeled L3, of cooling channels 30 as compared to inner surface 34, which in the exemplary embodiment shown corresponds to the longitudinal axis the permanent mold body 29 and the casting direction, is denoted by $\gamma$.

In this way too, a horizontally and vertically adjusted cooling effect in permanent mold body 29 may be achieved, especially by a suitable, practically adapted positioning and alignment of cooling channels 30.

LISTOF REFERENCE NUMERALS

1—permanent mold body
2—permanent mold cavity
3—end face
4—bottom end
5—cooling channel
6—upper side of 1
7—lower side of 1
8—sidewall
9—sidewall

10—longitudinal section
11—longitudinal section
12—kink
13—broad face wall
14—broad face wall
15—narrow face wall
16—narrow face wall
17—permanent mold wall
18—permanent mold body
19—cooling channel
20—cooling channel
21—longitudinal section of 18
22—longitudinal section of 18
23—longitudinal section of 19
24—longitudinal section of 19
25—upper side
26—lower side
27—kink
28—kink
29—mold body
30—cooling channel
31—upper side
32—lower side
33—inner surface of 29
L1—longitudinal axis of 10, 21 or 23
L2—longitudinal axis of 11, 22 or 24
α—angle
β—angle
γ—angle
B—region
F—casting surface
G—casting level
X—distance (between)

What is claimed is:

1. A liquid-cooled permanent mold for a continuous casting installation, comprising:

a shaping permanent mold body having cooling channels which extend in the permanent mold body from its upper casting input end face to its lower end face, wherein at least one cooling channel has two longitudinal sections having longitudinal axes with different alignments relative to a casting surface of the permanent mold body, the distance of the at least one cooling channel from the casting surface varying.

2. The permanent mold of claim 1, wherein the longitudinal sections have the same length.

3. The permanent mold of claim 1, wherein the longitudinal sections have different lengths.

4. The permanent mold of claim 1, wherein the cooling channels are formed by bores.

5. The permanent mold of claim 1, wherein the permanent mold body has two broad face walls lying opposite each other and two narrow face walls which limit the width of the strand, and wherein the cooling channels are situated in the broad face walls.

6. The permanent mold of claim 1, wherein a distance between adjacent cooling channels varies.

7. The permanent mold of claim 1, wherein the shaping permanent mold body is made of one of copper and a copper alloy.

8. The permanent mold of claim 1, further comprising an outer construction and wherein the shaping permanent mold body is made of a substance of high heat conductivity relative to the outer construction.

9. A liquid-cooled permanent mold for a continuous casting installation, comprising:

a shaping permanent mold body having cooling channels that extend in the permanent mold body from an upper input end face to a lower end face of the permanent mold body, wherein at least one cooling channel runs inclined to an adjacent inner surface of the permanent mold body.

10. The permanent mold of claim 9, wherein the cooling channels are formed by bores.

11. The permanent mold of claim 9, wherein the permanent mold body has two broad face walls lying opposite each other and two narrow face walls which limit a width of the strand, and wherein the cooling channels are situated in the broad face walls.

12. The permanent mold of claim 9, wherein a distance between adjacent cooling channels varies.

13. The permanent mold of claim 9, wherein the shaping permanent mold body is made of one of copper and a copper alloy.

14. The permanent mold of claim 9, further comprising an outer construction and wherein the shaping permanent mold body is made of a substance of high heat conductivity relative to the outer construction.

15. A liquid-cooled permanent mold for a continuous casting installation, comprising:

a shaping permanent mold body having cooling channels which extend generally longitudinally in the permanent mold body from its upper casting input end face to its lower end face, wherein at least one cooling channel has two longitudinal sections and is defined by a channel surface, each portion of the channel surface of each longitudinal section extending generally longitudinally but having different alignments relative to a casting surface of the permanent mold body, the distance of the at least one cooling channel from the casting surface varying.

* * * * *